United States Patent [19]

Fellwock et al.

[11] 3,982,798

[45] Sept. 28, 1976

[54] STORAGE APPARATUS

[75] Inventors: Charles G. Fellwock, Evansville, Ind.; Charles R. Russell, Southfield, Mich.

[73] Assignee: Whirlpool Corporation, Benton Harbor, Mich.

[22] Filed: Feb. 18, 1975

[21] Appl. No.: 550,546

[52] U.S. Cl. ..... 312/138 A; 312/214; 312/312

[51] Int. Cl.[2] ..... A47B 51/00

[58] Field of Search ..... 312/138 A, 291, 116, 312/214, 236, 312, 132, 42, 319, 311; 49/56; 5/100

[56] References Cited

UNITED STATES PATENTS

| | | | |
|---|---|---|---|
| 917,705 | 4/1909 | Benjamin | 312/213 |
| 1,074,932 | 10/1913 | Dickenson | 312/312 |
| 2,061,453 | 11/1936 | Crosley, Jr. et al. | 312/138 A |
| 2,327,735 | 8/1943 | Neunherz | 5/100 |
| 2,470,223 | 5/1949 | Powels | 312/311 |
| 2,563,208 | 8/1951 | Bugenhagen | 312/312 |
| 2,605,517 | 8/1952 | Rucker | 49/56 |
| 2,740,266 | 4/1956 | Kesling | 312/138 A |
| 2,767,042 | 10/1956 | Kesling | 312/291 |
| 2,849,270 | 8/1958 | Warnock | 312/319 |
| 2,903,315 | 9/1959 | Schory et al. | 312/214 |
| 2,976,101 | 3/1961 | Rooney | 312/138 A |
| 2,984,533 | 5/1961 | Sundberg | 312/138 A |

*Primary Examiner*—Paul R. Gilliam
*Assistant Examiner*—Victor N. Sakran
*Attorney, Agent, or Firm*—Wegner, Stellman, McCord, Wiles & Wood

[57] ABSTRACT

Storage apparatus with a vertical door with a storage recess facing inwardly, a shelf in the recess, an article retaining open rack for easy viewing of the retained articles extending across the recess in the vicinity of the shelf to retain articles within the recess and prevent their accidental dislodgement when the door is opened and closed and a cooperating guide and track on the door and the rack for guiding movement of the rack in a generally vertical path to an elevated position for exposing the shelf to provide ready access thereto in inserting and removing the articles.

4 Claims, 5 Drawing Figures

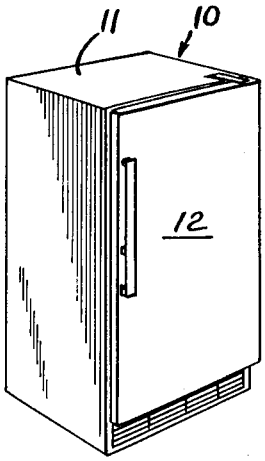
Fig. 1
Fig. 2
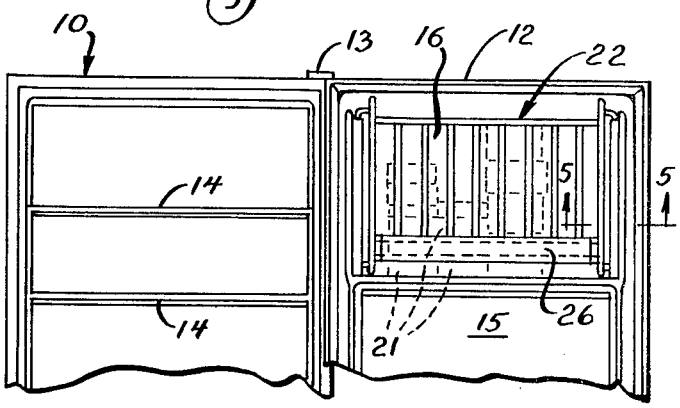
Fig. 3
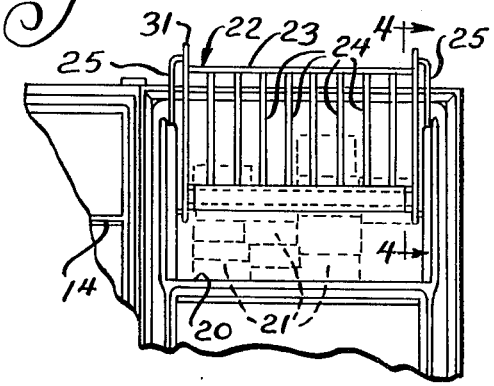
Fig. 4
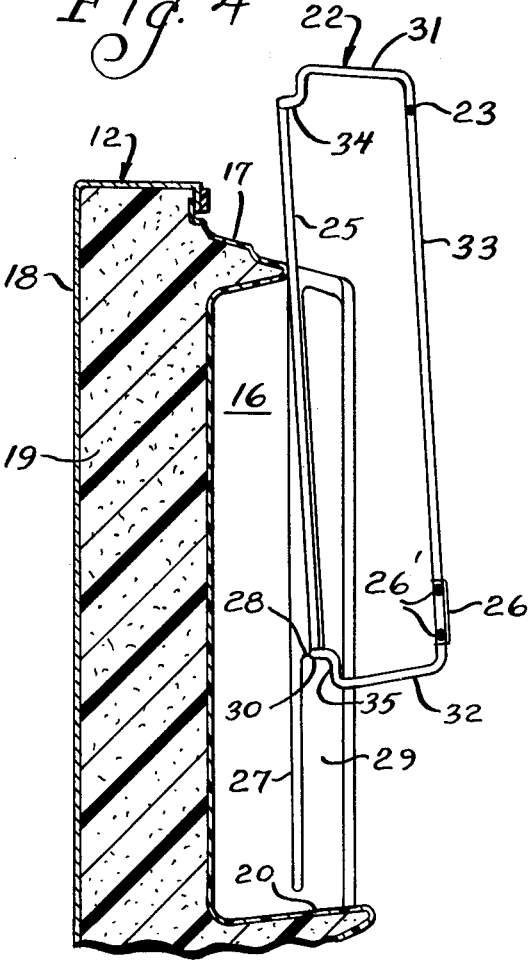
Fig. 5
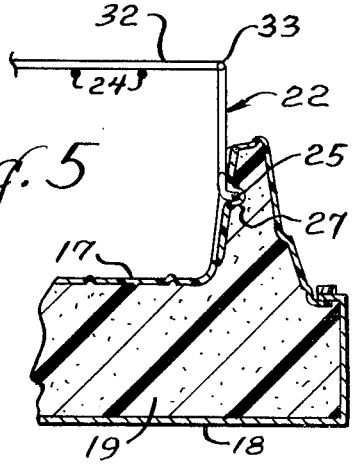

STORAGE APPARATUS

BACKGROUND OF THE INVENTION

In certain types of storage apparatus of which the illustrated vertical home freezer is a good example it is customary to use all of the interior storage space for the storage of articles. One such space is in the vertical door that is provided with storage space including a transverse article supporting shelf in a recess of the inner surface of the door facing the interior of the storage apparatus.

It has been customary in the past to provide low article retaining barriers for each shelf so that in opening and closing the door the articles will not be accidentally dislodged. Such an arrangement, however, has certain disadvantages among which are that tall articles or top heavy articles can be dislodged inwardly and tumble over the fixed barrier.

This invention solves this problem by providing a movable article retaining rack that is preferably of wire or other such construction that permits viewing of the articles retained behind the rack and with this rack extending across a recess in the vicinity of the shelf to retain articles within the recess and on the shelf especially when the door is being opened and closed. The invention also provides cooperating guide and track means on the door and the rack for guiding movement of the rack in a generally vertical path to an elevated position exposing the shelf for access thereto and to a normal position for retaining the articles on the shelf, as desired.

SUMMARY OF THE INVENTION

One of the features of this invention therefore is to provide storage apparatus that includes a vertical door with an inwardly facing recess comprising a storage space for the storage of articles, a transverse supporting shelf in the recess and a movable article retaining rack extending across the recess and generally vertically movably to elevated shelf exposed position and to lower article retaining position.

BRIEF DESCRIPTION OF THE DRAWINGS

FIG. 1 is a perspective view of a vertical household type freezer embodying the invention.

FIG. 2 is a fragmentary front elevational view of the freezer of FIG. 1 and with the door open and showing the retained articles in broken lines.

FIG. 3 is a view similar to FIG. 2 but illustrating the article retaining rack in elevated position.

FIG. 4 is an enlarged fragmentary vertical sectional view taken substantially along line 4—4 of FIG. 3.

FIG. 5 is an enlarged horizontal sectional view taken substantially along line 5—5 of FIG. 2.

DESCRIPTION OF THE PREFERRED EMBODIMENT

In the embodiment illustrated in the drawings the storage apparatus 10 is embodied in a vertical freezer comprising the insulated cabinet 11 and vertical door 12 mounted for movement between the closed position of FIG. 1 and the open position of FIGS. 2 and 3 about hinges 13 in the customary manner. The cabinet 11 is provided with the customary shelves 14.

The door 12 is provided with storage space embodied in inwardly directed recesses 15 and 16 formed in the liner 17 in the customary manner. As is generally true the liner 17 is spaced from the sheet metal shell 18 of the door 12 and between them is located the customary insulation 19 such as fiberglass.

The storage space as illustrated at 16 is defined on the bottom by a transverse article supporting shelf means 20 on which articles are adapted to be stored as indicated in FIGS. 2 and 3 by the broken line designation of the articles 21. In order to retain these articles within the storage space 16 there is provided a movable article retaining rack 22 that may be made of wire and the like including a top wire 23, intermediate spaced vertical wires 24 to provide easy viewing of the articles 21 behind the lowered rack as shown in FIG. 2, side wires 25 and a bottom retaining horizontal band 26 carried by two bottom wires 26'. (The wires are shown in FIGS. 2 and 3 in exaggerated size for clarity of illustration.)

As is illustrated in FIG. 2 the rack 22 normally extends across the space 16 when the rack is in lowered position so as to retain the articles 21 against accidental dislodgment particularly on opening and closing the door 12 but still permitting unobstructed viewing of the articles.

In order to permit removal of the articles from the storage space 16 and inserting of the articles when such is desired there are provided cooperating guide and track means on the door 12 and the rack 22 for guiding movement of the rack in a generally vertical path as illustrated by a comparison between FIGS. 2 and 3 to an elevated position of FIG. 3 exposing the shelf 20 for access thereto.

In the illustrated embodiment this cooperating guide and track means comprising the side wires 25 that are retained in generally vertical parallel side grooves 27, also formed in the liner 17.

In order to facilitate inserting and removing the articles 21 with relation to the storage space 16 there are provided means for retaining the rack in elevated shelf exposing position as illustrated in FIG. 3. This means for retaining comprises oppositely located side catch means in the form of generally horizontal steps 28 formed in the sides 29 of the liner portion that defines the storage space 16. There is one step on each side of the storage space 16 in the illustrated embodiment although there could of course be more provided to retain the rack 22 in more than one elevated position. These steps are in pairs as illustrated by the one pair and each step 28 has a downwardly directed recess 30 to aid in retaining the rack in the elevated position of FIGS. 3 and 4 and prevent accidental dislodgment.

The wire rack 22 has structural features that not only permit it to be held in the elevated position of FIG. 3 and in the lowered position of FIG. 2 but also gives added strength to the rack. Thus the rack has the side wires 31 generally horizontal and corresponding bottom wires 32 also generally horizontal and joined to the side wires 33 to make a rigid end structure for each end of the wire rack 22. Then for added strength the top and bottom wires 31 and 32 are each integral with the rear side wires 25 at each end of the rack by way of a laterally offset angled part 34 and 35 at each upper rear corner of the rack 22 so that the side wires 25 which serve as a part of the guide means are properly positioned for vertical travel in the side guiding grooves 27.

The foregoing disclosure of specific embodiments is illustrative of the broad inventive concepts comprehended by the invention.

Having described the invention, the embodiments of the invention in which an exclusive property or privilege is claimed are defined as follows:

1. Storage apparatus, comprising: a vertical door having storage space for articles comprising an inwardly facing recess; a transverse article supporting shelf means in said recess; a generally vertically movable article retaining rack extending across said recess in the vicinity of said shelf means to retain articles within said recess and on said shelf means; and cooperating sliding guide and track means on said door and said rack for sliding movement of said movable rack in a generally vertical path to an elevated position exposing said shelf means for access thereto, said storage apparatus comprising refrigeration apparatus and said door comprising an inner liner shaped to provide said inwardly facing recess, said liner including substantially vertical track grooves at the laterally opposite sides of said recess engaged by side members on said rack for providing said sliding movement of said rack.

2. The apparatus of claim 1 wherein said liner comprises shaped portions comprising catch means for engaging and retaining said rack in said elevated position.

3. The apparatus of claim 1 wherein said rack has an inner side projecting inwardly beyond said liner and said recess.

4. The apparatus of claim 1 wherein said liner comprises shaped portions comprising catch means for engaging and retaining said rack in said elevated position, and said rack has an inner side projecting inwardly beyond said liner and said recess and said catch means.

* * * * *